US008552662B2

(12) United States Patent
Sun et al.

(10) Patent No.: US 8,552,662 B2
(45) Date of Patent: Oct. 8, 2013

(54) DRIVER FOR PROVIDING VARIABLE POWER TO A LED ARRAY

(75) Inventors: Xiao Sun, Shanghai (CN); Bertrand Hohan Edward Hontele, Breda (NL)

(73) Assignee: Koninklijke Philips N.V., Eindhoven (NL)

( * ) Notice: Subject to any disclaimer, the term of this patent is extended or adjusted under 35 U.S.C. 154(b) by 285 days.

(21) Appl. No.: 13/120,347

(22) PCT Filed: Sep. 2, 2009

(86) PCT No.: PCT/IB2009/053821

§ 371 (c)(1),
(2), (4) Date: Mar. 22, 2011

(87) PCT Pub. No.: WO2010/035155

PCT Pub. Date: Apr. 1, 2010

(65) Prior Publication Data

US 2011/0175543 A1 Jul. 21, 2011

(30) Foreign Application Priority Data

Sep. 25, 2008 (CN) ..... 2008 1 0149743

(51) Int. Cl.
*H05B 37/02* (2006.01)

(52) U.S. Cl.
USPC ..... 315/294; 315/308; 315/307

(58) Field of Classification Search
USPC ..... 315/209 R, 247, 224, 287, 291, 307, 312
See application file for complete search history.

(56) References Cited

U.S. PATENT DOCUMENTS

| | | | | |
|---|---|---|---|---|
| 7,358,679 | B2 | 4/2008 | Lys et al. | |
| 7,656,103 | B2 * | 2/2010 | Shteynberg et al. | 315/312 |
| 7,667,408 | B2 * | 2/2010 | Melanson et al. | 315/209 R |
| 7,902,769 | B2 * | 3/2011 | Shteynberg et al. | 315/291 |
| 8,212,491 | B2 * | 7/2012 | Kost et al. | 315/247 |
| 2007/0182338 | A1 | 8/2007 | Shteynberg et al. | |
| 2008/0018261 | A1 * | 1/2008 | Kastner | 315/192 |
| 2008/0150450 | A1 | 6/2008 | Starr et al. | |
| 2008/0258647 | A1 * | 10/2008 | Scianna | 315/291 |

FOREIGN PATENT DOCUMENTS

DE 10119491 A1 7/2002

OTHER PUBLICATIONS

Supertex Inc., "HV9931 Unity Power Factor LED Lamp Driver", 2007, pp. 1-20, Sunnyvale, CA.

* cited by examiner

*Primary Examiner* — Vibol Tan
(74) *Attorney, Agent, or Firm* — Yuliya Mathis

(57) ABSTRACT

A driver for providing variable power to a LED array, which can be coupled through a dimmer to an AC power supply, comprises a filtering and rectifying unit, a switching power unit, and a control unit. The filtering and rectifying unit is adapted to attenuate EMI and convert an AC power from the AC power supply into a DC power output. The switching power unit is adapted to receive the DC power output and provide an output current to the LED array. The control unit is adapted to determine the output current in response to a comparison between a dim reference signal representing phase-modulating information of the AC power and a feedback signal representing an average value of the output current. The LED array can thus be controlled by a dimmer at the primary side so as to adjust its light output, and can further be utilized in currently existing lighting infrastructures.

14 Claims, 3 Drawing Sheets

DRIVER FOR PROVIDING VARIABLE POWER TO A LED ARRAY

FIELD OF THE INVENTION

The present invention relates in general to a driver for providing power to a light-emitting diode (LED) array, more specifically, to a driver for providing variable power to a LED array. The present invention also relates to a method of providing variable power to a LED array.

BACKGROUND OF THE INVENTION

Light-emitting diodes (LEDs) are used as a kind of solid-state light source. Compared with traditional light sources, such as incandescent or fluorescent lamps, its advantages are compactness, high efficacy, good color, various and variable colors, etc. Thus, LEDs are widely applied in indoor lighting, decoration lighting, and outdoor lighting. Some of these applications require the output light from the LEDs to be adjustable from 1% to 100% of the maximum light output, that is, users often require a dimming capability.

In order to dim the light output of the LEDs, it is required to control the output current of the LED driver to follow a certain dim input. Currently, most LED drivers achieve the dimming function by chopping the output current through an extra Mosfet, and the current to the LEDs can be controlled by changing the duty cycle of the Mosfet via a dim input. Alternatively, the dimming function is achieved by modulating the output current by a dim input, which is usually an analog voltage level or PWM (pulse width modulation) signal. These dimming methods have a common feature in that the dim input is at the secondary side of the driver, which is referred to as secondary dimming.

In traditional lighting, a phase-modulating dimmer is commonly used for dimming the light output and is usually connected at the power input terminal of the driver. The phase-modulating dimmer cuts the phase of the input voltage from the power supply, and finally the output current to a burner is controlled. By turning a knob of the dimmer, users can thus easily control the light output. Since the dim input is at the primary side of the driver, such a dimming method is referred to as primary dimming.

Due to the dim input of the LED driver described above at the secondary side rather than at the primary side, these LED drivers are incompatible with phase-modulating dimmers, which are originally utilized to alter the brightness or intensity of the light output in traditional lighting. Consequently, many of these drivers are incompatible with the existing lighting system infrastructure, such as the lighting systems typically utilized for incandescent or fluorescent lighting.

It is therefore desirable to develop a LED driver which is compatible with the existing phase-modulating dimmers.

SUMMARY OF THE INVENTION

In accordance with one aspect, the present invention provides a driver for providing variable power to at least one LED array. The driver is intended to be coupled through a phase-modulating dimmer to the AC power supply and comprises a filtering and rectifying unit, a switching power unit, and a control unit. The filtering and rectifying unit is adapted to attenuate electromagnetic interference (EMI) from/to the AC power supply and convert an AC power from the AC power supply into a DC power output. The switching power unit is adapted to receive the DC power output from the filtering and rectifying unit and provide an output current to the LED array.

The control unit is adapted to determine the output current to the LED array in response to a comparison between a dim reference signal representing phase-modulating information of the AC power when the phase angle of the AC power is cut by the dimmer and a feedback signal representing an average value of the output current to the LED array.

In accordance with another aspect, the present invention provides a lighting device which comprises at least one LED array and the above-mentioned driver.

In accordance with yet another aspect, one embodiment of the invention provides a method of providing variable power to at least one LED array. The method comprises the steps of supplying current to the LED array by means of a power supply, and adjusting the current in accordance with a dimming demand signal at an input side of the power supply, by performing a comparison between a dim reference signal representing phase-modulating information at the input side of the power supply and a feedback signal representing an average value of the current to the LED array.

With the help of the driver/method according to embodiments of the invention, the LED array can be controlled by any of a variety of switches at the primary side (i.e. the input side), such as a phase-modulating dimmer, to adjust the light output, and can be further utilized with the currently existing lighting infrastructure.

BRIEF DESCRIPTION OF THE DRAWINGS

The foregoing forms as well as other forms, features and advantages of the present invention will become apparent from the following detailed description of preferred embodiments with reference to the accompanying drawings. The detailed description and drawings are merely illustrative and do not limit the present invention.

DESCRIPTION OF EMBODIMENTS

Figure 1:
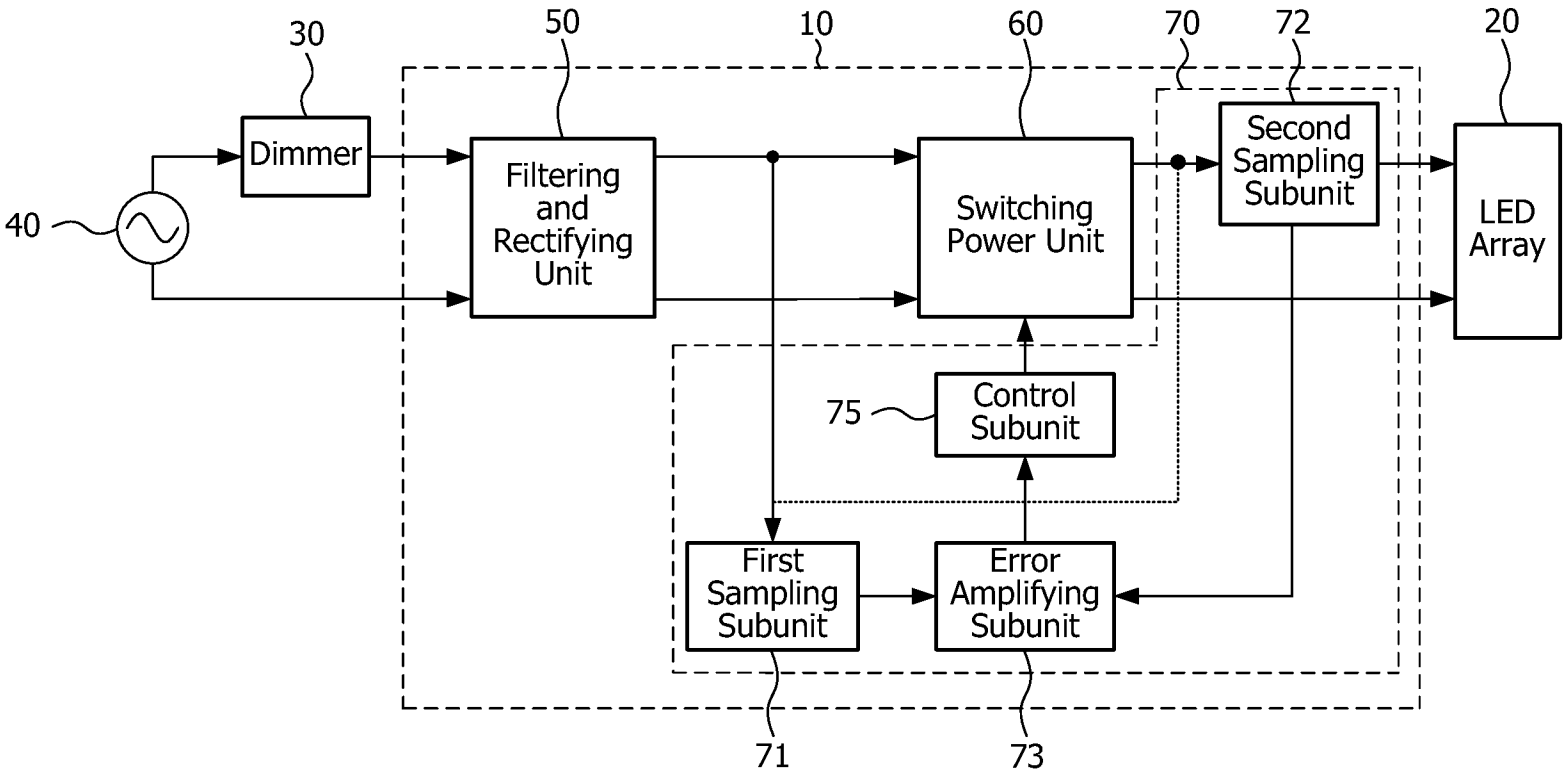
FIG. 1 is a schematic diagram of a driver according to a first embodiment of the invention.

FIG. 1 illustrates a driver 10 according to a first embodiment of the present invention. The driver 10 is configured to provide variable power to a LED array 20. The driver 10 is coupled through a dimmer 30 to an AC power supply 40 for transforming an AC power from the AC power supply 40 into a DC power which is suitable for the LED array 20 and satisfies different dimming requirements.

The driver 10 comprises a filtering and rectifying unit 50, a switching power unit 60, and a control unit 70. The filtering and rectifying unit 50 is adapted to attenuate electromagnetic interference (EMI) from and/or to the AC power supply 40 and further convert an AC power from the AC power supply 40 into a DC power output. The switching power unit 60 is adapted to receive the DC power output from the filtering and rectifying unit 50, and further provide an output current to the LED array 20 under the control of the control unit 70. The control unit 70 is adapted to determine the output current to the LED array 20 in response to a comparison between a dim reference signal representing phase-modulating information of the AC power when the phase angle of the AC power is modulated by the dimmer 30 and a feedback signal representing an average value of the output current to the LED array 20.

Advantageously, the control unit 70 may comprise a first sampling sub-unit 71, a second sampling sub-unit 72, an error amplifying sub-unit 73 and a control sub-unit 75.

The first sampling sub-unit 71 is configured to sample the dim reference signal and further cause the dim reference signal to be in a low frequency range. In some embodiments, the dim reference signal may be approximately a flat voltage signal. Here and in similar situations hereinafter, "approximately" is understood to mean that the voltage signal may fluctuate in a limited and acceptable range and is possibly not an absolutely flat signal. For example, the voltage value of the voltage signal may fluctuate around a certain value with an error of ±5%. Alternatively, the first sampling sub-unit 71 can be coupled to a primary side or a secondary side of the switching power unit 60.

The second sampling sub-unit 72 is configured to sample the feedback signal and further cause the feedback signal to be in a low frequency range. In some embodiments, the feedback signal is filtered out of high-frequency switching components and kept in a voltage waveform in accordance with a current waveform of the output current to the LED array 20.

The error amplifying sub-unit 73 is configured to implement the comparison between the dim reference signal from the first sampling sub-unit 71 and the feedback signal from the second sampling sub-unit 72. In some embodiments, the error amplifying sub-unit 73 is configured to have a crossover frequency of 5-30 HZ.

The control sub-unit 75 is configured to implement the control operation on the switching power unit 60 based on the comparison result from the error amplifying sub-unit 73.

When the dimmer 30 is set at different operation levels by a user, the voltage of the AC power supply 40 will be cut at different phase angles, which will be embodied in the dim reference signal and further embodied in the comparison result. Therefore, the switching power unit 60 can operate under the control of the control unit 70 for providing an output current to the LED array 20 in accordance with the dimming demand signal by the user. The dimming function is realized by controlling the average value of the output current to the LED array 20 following the phase cut of the voltage of the AC power from the AC power supply 40.

Figure 2:
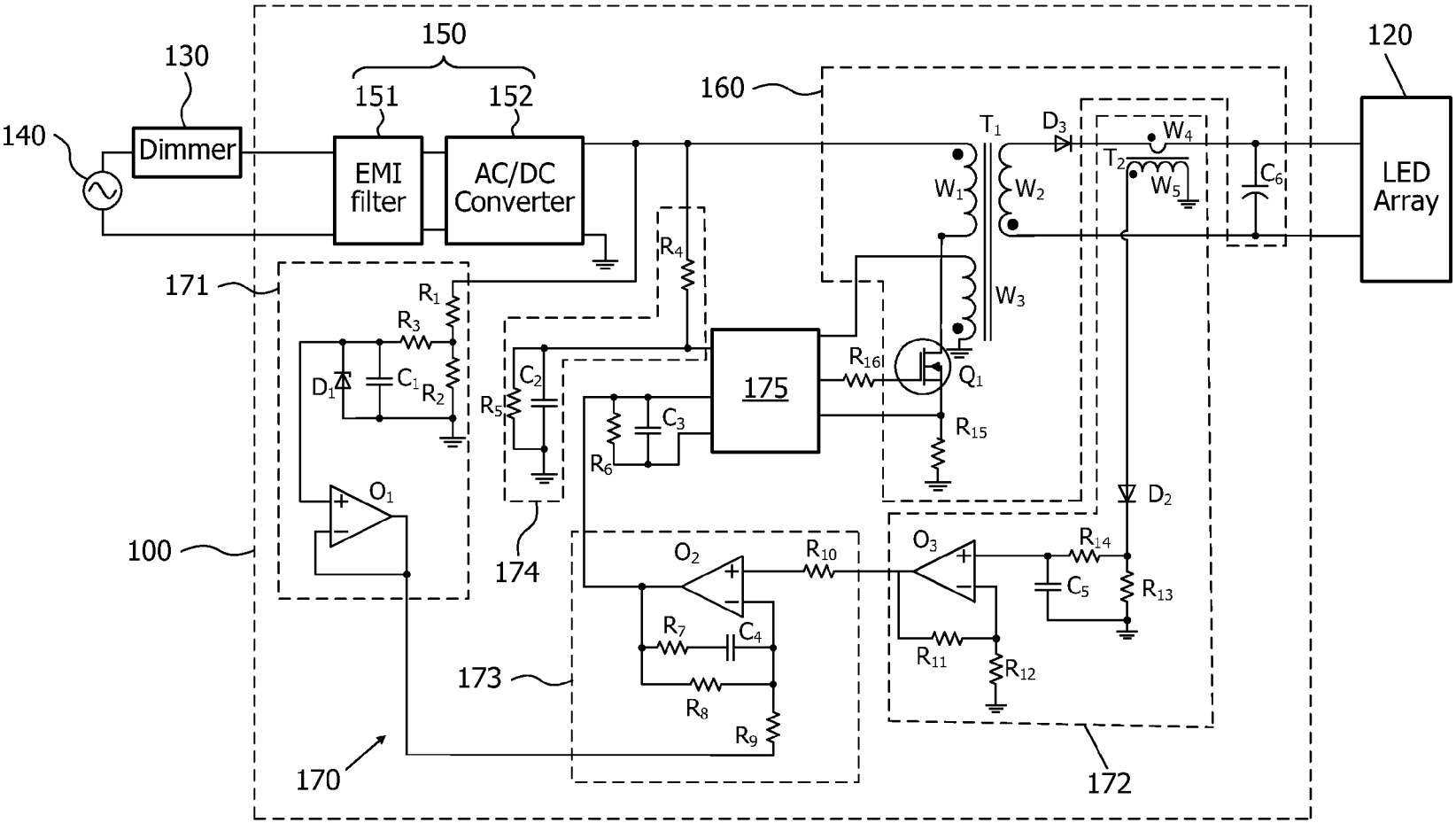
FIG. 2 is a circuit diagram of a driver according to a second embodiment of the invention.

FIG. 2 is an example of a circuit diagram of a driver 100 according to a second embodiment of the invention. The driver 100 is coupled between a LED array 120 and an AC power supply 140 via a dimmer 130 for providing a DC power to the LED array 120. The driver 100 comprises a filtering and rectifying unit 150 including an EMI filter 151 and an AC/DC converter 152, a switching power unit 160, and a control unit 170 including a first sampling sub-unit 171, a second sampling sub-unit 172, an error amplifying sub-unit 173, a third sampling sub-unit 174 and a control sub-unit 175.

The EMI filter 151 is adapted to attenuate electromagnetic interference (EMI) from/to the AC power supply 140. The AC/DC converter 152 is adapted to convert an AC power from the AC power supply 140 into a DC power output and may be a bridge rectifier. Alternatively, the EMI filter 151 and the AC/DC converter 152 may be any type in the art and a detailed description thereof will be omitted.

The switching power unit 160 is coupled between the AC/DC converter 152 and the LED array 120 and configured to receive the DC power output from the AC/DC converter 152 and further provide an output current to the LED array 120. The switching power unit 160 comprises a flyback transformer T1, an output rectifier diode D3, an output filter capacitor C6, an active switching transistor Q1, and a resistor R15.

The flyback transformer T1 includes a primary winding W1, a secondary winding W2 and an additional winding W3. The primary winding W1 combined with the active switching transistor Q1 and resistor R15 in series is coupled between an output terminal of the AC/DC converter 152 and ground at the primary side. The secondary winding W2 is connected to the LED array 120 via the rectifier diode D3 for providing current to the LED array 120. The capacitor C6 is connected in parallel with the LED array 120 and located after the rectifier diode D3 in the current flow direction. The output current to the LED array 120 equals the capacitor C6 current subtracted from the rectifier diode D3 current. The capacitor C6 current has a high AC frequency, so the output current to the LED array 120 is maintained at a low frequency by filtering the rectifier diode D3 current with capacitor C6. The additional winding W3 is operable to provide a zero-crossing detection signal to the control unit 170, as is well-known to those skilled in the art. The flyback transformer T1 is controlled by the control unit 170 via the active switching transistor Q1, which will be illustrated below.

The first sampling sub-unit 171 is configured to detect a dim reference signal from the primary side of the flyback transformer T1. The first sampling sub-unit 171 comprises resistors R1, R2, R3, a capacitor C1, a Zener diode D1, and an operational amplifier O1. Resistors R1 and R2 are first connected in series and then coupled between an output terminal of the AC/DC converter 152 and ground at the primary side. Resistors R1 and R2 form a voltage divider so as to sample the dim reference signal from the output of the AC/DC converter 152, and consequently the dim reference signal can represent phase-modulating information of the AC power. The phase modulation is caused by the dimmer 130 when set at a different operation level by a user. Resistor R3 and capacitor C1 are connected in series and then coupled between ground and a node of resistors R1 and R2. Resistor R3 and capacitor C1 form a low-pass filter, and their values are selected in such a way that they can cause the dim reference signal to be in a low frequency range. Alternatively, the values of resistor R3 and capacitor C1 are selected in such a way that the dim reference signal may even be approximately a flat voltage signal. Zener diode D1 is connected in parallel with capacitor C1 and is configured to clamp the maximum of the dim reference signal, so that the maximum of the output current to the LED array 120 can be limited in the case of a high input voltage from the AC power supply 140, e.g. 264V. Then the dim reference signal is buffered by the operational amplifier O1 before being sent to the error amplifying sub-unit 173. Consequently, after the above-mentioned treatments, the dim reference signal is extracted to represent phase-modulating information of the AC power and be in a low frequency range as well as at a level that the error amplifying sub-unit 173 can allow.

The second sampling sub-unit 172 is configured to sense a feedback signal representing an average value of the output current to the LED array 120 and cause the feedback signal to be in a low frequency range. Alternatively, the second sampling sub-unit 172 is configured to cause the feedback signal to be in a voltage waveform in accordance with a current waveform of the output current to the LED array 120. The second sampling sub-unit 172 comprises a current transformer T2, resistors R11, R12, R13, R14, a capacitor C5, a diode D2, and an operational amplifier O3.

The current transformer T2 includes a primary winding W4 and a secondary winding W5. The primary winding W4 can be coupled before or after diode D3, but before capacitor C6, in the current flow direction. The secondary winding W5, diode D2 and resistor R13 are sequentially connected in series to form a loop. The feedback signal is extracted from a node of diode D2 and resistor R13. The voltage of the feedback signal $V_f$ is proportional to the rectifier diode D3 current $I_{D3}$, and $V_f = N_{T2} \times R_{13} \times I_{D3}$, wherein $N_{T2}$ is the ratio of turns of T2. The feedback signal is thus kept in a voltage waveform in accordance with a current waveform of the output current to the LED array 120.

Resistor R14 and capacitor C5 are connected in series and then coupled between ground at the primary side and a node of diode D2 and resistor R13, and form a low-pass filter to remove high-frequency components from the feedback signal. The values of resistor R14 and capacitor C5 are selected in such a way that the feedback signal is in a low frequency range. After the low-pass filter, the feedback signal represents the average current value of the output current to the LED array 120 over a mains period, in a low bandwidth.

The operational amplifier O3 is employed to enlarge the scale of the voltage of the feedback signal $V_f$ and functions as an impedance matcher to subsequent circuitry. Resistors R11 and R12 are connected in series between ground at the primary side and the output terminal of the operational amplifier O3, and a node of resistors R11 and R12 is connected to an inverting input terminal of the operational amplifier O3. The voltage of the feedback signal $V_f$ will thus be increased by 1+R11/R12 and will be at a level that the error amplifying sub-unit 173 can allow.

The error amplifying sub-unit 173 is configured to implement the comparison between the dim reference signal and the current feedback signal and produce a dim control voltage signal based on the comparison to the control sub-unit 175. In some embodiments, the dim control voltage signal varies as the dimmer 130 is varied from its highest to its lowest setting. As described above, the setting of dimmer 130 is sensed via the first sampling sub-unit 171, and embodied in the dim reference signal. As will be more fully explained below, the dim control voltage signal is used to control the light output of the LED array 120 via control of the output current to the LED array 120. In some embodiments, the light output of the LED array 120 is at its lowest level when the dim control voltage signal is at its highest level, and the light output of the LED array 120 is at its highest level when the dim control voltage signal is at its lowest level.

The error amplifying sub-unit 173 comprises an operational amplifier O2 and components such as resistors R7, R8, R9, R10 and capacitor C4. The operational amplifier O2 receives the dim reference signal as an inverting input from the first sampling sub-unit 171 via resistor R9, and the feedback signal as a non-inverting input from the second sampling sub-unit 172 via resistor R10, and outputs a DC voltage as the dim control voltage signal for an input of the control sub-unit 175. The average value of the output current to the LED array 120 will thus follow the dim reference signal, i.e. the input voltage which has a phase angle cut by the dimmer 130. The series-wound combination of resistor R7 and capacitor C4 is in parallel with resistor R8 and coupled between the output terminal and the inverting input of the operational amplifier O2. The DC gain of the operational amplifier O2 is R8/R9. Resistor R7 and capacitor C4 will introduce a zero-crossing into the control loop of the control unit 170. Increasing the value of capacitor C4 will move this zero-crossing towards the low-frequency side and accordingly gives the control loop a larger phase margin, resulting in a stabler control.

The third sampling sub-unit 174 is configured to detect a voltage signal reflecting the voltage waveform of the AC power from the AC power supply 140, and the voltage signal is used to implement a power factor correction (PFC). In one embodiment, the third sampling sub-unit 174 comprises resistors R4, R5, and capacitor C2. Resistors R4, R5 are sequentially coupled in series between an output terminal of the AC/DC converter 152 and ground at the primary side, and capacitor C2 is in parallel with resistors R5. The resistors R4 and R5 form a voltage divider, and the voltage signal is extracted from a node of resistors R4 and R5 and formed on resistor R4. The voltage signal is thus reduced and directly proportional to the output voltage of the AC/DC converter 152, and will reflect the voltage waveform of the output from the AC/DC converter 152, and will accordingly reflect the voltage waveform of the AC power from the AC power supply 140 after the phase angle is cut by dimmer 130. The voltage signal is further provided to the control sub-unit 175 so as to be multiplied by the dim control voltage signal and used to force the output current to the LED array 120 so as to follow the waveform of the output voltage of the AC power. A high power factor can therefore be achieved.

If a relatively lower power factor is acceptable, for example, for a LED array with an input power lower than 25 W, the third sampling sub-unit 174 cannot be included in some embodiments.

The control sub-unit 175 is selected to include an integrated circuit and is configured to provide a transformer control signal to control the operation of the flyback transformer T1 based on the dim control voltage signal from the error amplifying sub-unit 173 and/or the voltage signal for PFC control from the third sampling sub-unit 174. In some embodiments, the control sub-unit 175 comprises a control IC such as L6561 or L6562 manufactured by ST Microeletronics Inc, or MC33262 from Onsemi, which has power factor correction configuration, and some components such as resistors R6 and R16, and capacitor C3. In order to have a good PFC performance, it is better in some embodiments to keep the cross-over frequency of the control unit 170 lower than 50 HZ, which is mainly determined by the value of resistor R6 and capacitor C3. Alternatively, the cross-over frequency of the control unit 170 can be designed to be lower than 15 HZ, or even lower than 10 HZ.

If there is no special requirement imposed on the power factor, the control IC can be alternatively selected in a configuration without a power factor correction, such as UC384X manufactured by Texas Instruments. The control sub-unit 175 is thus configured to provide a transformer control signal to control the operation of the flyback transformer T1 merely on the basis of the dim control voltage signal from the error amplifying sub-unit 173. Alternatively, the control sub-unit 175 may have a different configuration, e.g. it may comprise a programmed processor or unit, as long as such a configuration fulfils the above-mentioned function.

Via the transformer control signal, the control unit 170 can adjust the current flow through the winding W1 of the flyback transformer T1 so as to match the LED array 120 current demands. The transformer control signal is input to the flyback transformer T1 when the control sub-unit 175 of the control unit 170 pulses the gate of active switching transistor Q1 through resistor R16. The pulsed signals from the active switching transistor Q1 allow energy transfer through the transformer windings W1/W2 so as to provide the output current to the LED array 120.

Figure 3:
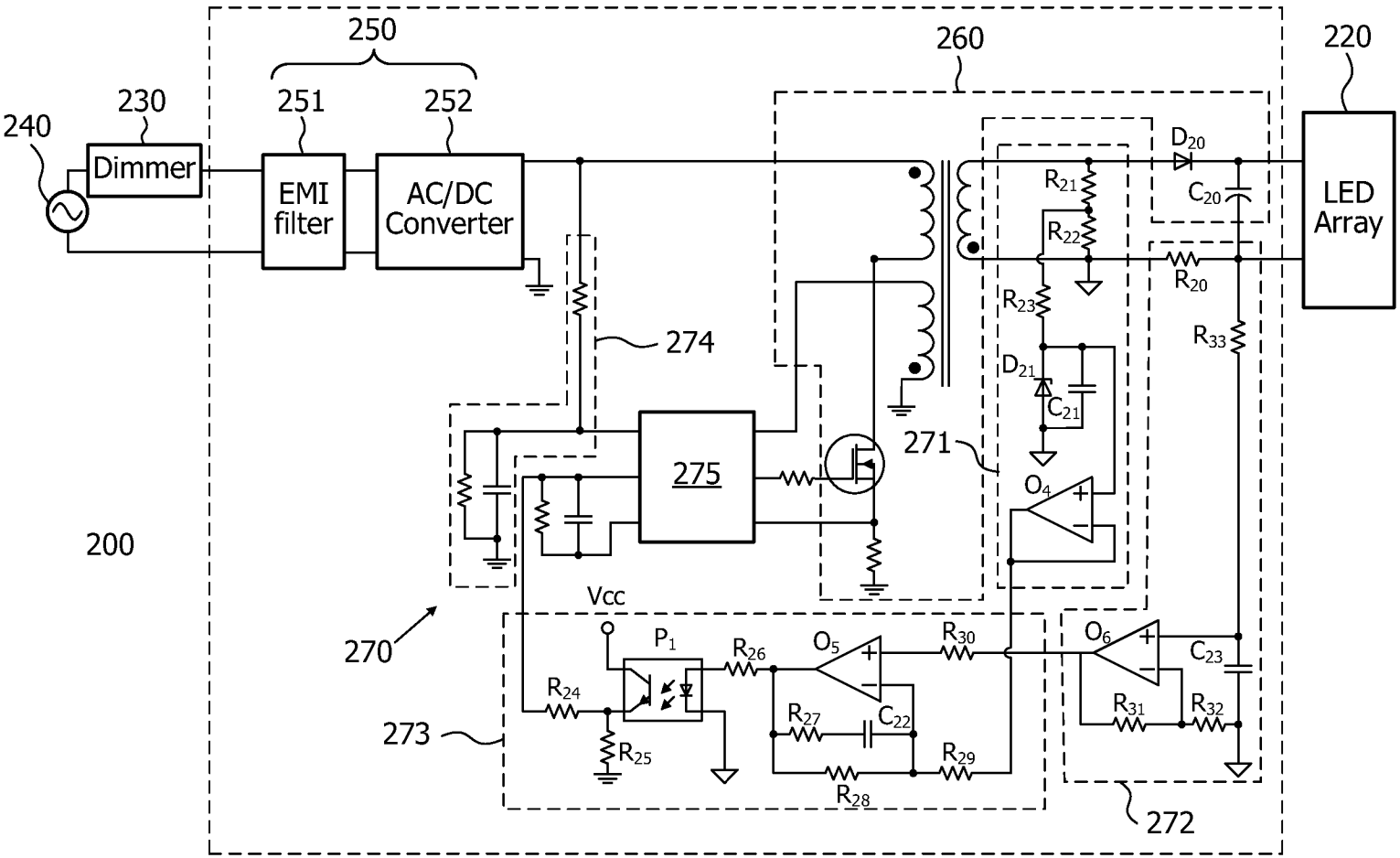
FIG. 3 is a circuit diagram of a driver according to a third embodiment of the invention.

FIG. 3 is another example of a circuit diagram of a driver 200 according to a third embodiment of the invention. In general, the driver 200 has a configuration similar to that of the driver 100 shown in FIG. 2. The driver 200 is also coupled, by way of example, between a LED array 220 and an AC power supply 240 via a dimmer 230 for providing a variable DC power to the LED array 220.

The driver 200 comprises a filtering and rectifying unit 250 including an EMI filter 251 and an AC/DC converter 252, a switching power unit 260, and a control unit 270 including a first sampling sub-unit 271, a second sampling sub-unit 272, an error amplifying sub-unit 273, a third sampling sub-unit 274, and a control sub-unit 275. Except for the first sampling sub-unit 271, the second sampling sub-unit 272 and the error amplifying sub-unit 273, other parts of the driver 200 are designed to have the same functions as those of the corresponding parts of the driver 100. These corresponding parts may therefore have a similar configuration. Consequently, the following description of the driver 200 will mainly focus on the first sampling sub-unit 271, the second sampling sub-unit 272 and the error amplifying sub-unit 273.

The first sampling sub-unit 271 is configured to detect a dim reference signal from a secondary side of the flyback transformer T3. The first sampling sub-unit 271 is designed with components and a layout similar to those of the first sampling sub-unit 171 of the driver 100, except for its connection to the flyback transformer T3. The first sampling sub-unit 271 comprises resistors R21, R22, R23, a capacitor C21, a Zener diode D21, and an operational amplifier O4. Resistors R21 and R22 are first connected in series and then coupled between an output terminal at the secondary side of flyback transformer T3 and ground at the secondary side. Consequently, resistors R21 and R22 form a voltage divider so as to sample the dim reference signal from the output of flyback transformer T3. A description on the function and connection of other components of the first sampling sub-unit 271 is not repeated anymore because it is similar to the first sampling sub-unit 171 described hereinbefore. The output of the flyback transformer T3 is proportional to its input, which follows the AC power from the AC power supply, so that the dim reference signal can represent phase-modulating information of the AC power. Alternatively, resistor R23 and capacitor C21 can cause the dim reference signal to be in a low frequency range, even approximately a flat voltage signal.

The second sampling sub-unit 272 comprises resistors R20, R31, R32 and R33, a capacitor C23, and an operational amplifier O6. Resistor R20 is connected to ground at the secondary side via its output terminal and to a node of capacitor 20 of the switching unit 260 and an output terminal of the LED array 220 via its input terminal. A feedback signal is extracted from the input terminal of the resistor R20, and the voltage of the feedback signal $V_f$ is proportional to the rectifier diode D20 current $I_{D20}$, and $V_f=R_{20}*I_{D20}$. Resistor R33 and capacitor C23, similar to resistor R14 and capacitor C5 of driver 100, are connected in series and then coupled between ground at the secondary side and the input terminal of the resistor R20, and form a low-pass filter to remove high-frequency components from the feedback signal. The function and layout of the operational amplifier O6, resistors R31 and R32 is the same as that of the operational amplifier O3, resistors R11 and R12 (see the second embodiment described above). Consequently, the feedback signal sampled by the second sampling sub-unit 272 can represent the average value of the output current to the LED array 220 over a mains period, in a low bandwidth, and is at a level that the error amplifying sub-unit 273 can allow.

The error amplifying sub-unit 273 comprises an operational amplifier O5 and components such as resistors R27, R28, R29, R30 and a capacitor C22. The operational amplifier O5 is adapted to receive the dim reference signal from the first sampling sub-unit 271 via resistor R29 and the feedback signal from the second sampling sub-unit 272 via resistor R30, and is adapted to produce a comparison result between the dim reference signal and the feedback signal. The function and layout of resistors R27 and R28, and capacitor C22 is the same as that of resistors R7 and R8, and capacitor C4, as described above with reference to the second embodiment.

Since the dim reference signal and the feedback signal are produced at the secondary side of the switching unit 260, and the comparison result is used to control the switching unit 260 at the primary side, an isolation device, such as an electro-optical isolation device, is needed to isolate the primary and the secondary side for reasons of security. In this embodiment, the error amplifying sub-unit 273 therefore further comprises an optical coupler P1 as the isolation device. The comparison result from the operational amplifier O5 is sent to the optical coupler P1 via resistor R26, and a dim control voltage signal is obtained from the emitter of the optical coupler P1 via resistor R24. Resistor R25 is connected between the emitter of the optical coupler P1 and primary ground.

The control sub-unit 275 then controls the switching power unit 260 on the basis of the dim control voltage signal from the error amplifying sub-unit 273 and/or the voltage signal for PFC control from the third sampling sub-unit 174. Consequently, the light output of the LED array 220 is adjusted in accordance with the dimming requirement imposed by the user by employing a common dimmer at the AC power input side.

In the embodiments described above and shown in FIGS. 2 and 3, the active switching transistor Q1 of the switching power unit can be selected to be an n-channel Mosfet. In an alternative embodiment, other types of transistors, such as an insulated gate bipolar transistor (IGBT) or a bipolar transistor, can be used instead of an n-channel Mosfet so as to adjust the current.

In some embodiments, as described above, the switching power unit is in a single stage configuration. Such a configuration has advantages such as low cost and relatively easy design because of the smaller number of required components. In other embodiments, the switching power unit can be configured in a two-stage configuration and may comprise, for example, a boost converter followed by a flyback converter, or a flyback converter followed by a buck converter.

In embodiments of the present invention, the dimmer employed may be any one of a variety of switches in the art, preferably a phase-modulating dimmer; the LED array may be one array or multiple arrays of LEDs of any type or color, and each array may include at least one LED; the AC power supply may be 220V/50 HZ or 110V/60 HZ without any special requirement.

In some embodiments as described above, the response frequency of the whole control loop is quite low, which is achieved by a low cross-over frequency of the error amplifying sub-unit and the control sub-unit. By low-pass filtering the signals of the reference signal from the first sampling sub-unit and the feedback signal from the second sampling sub-unit, the control loop only handles the average value of the output current to the LED array in a low frequency range. Consequently, in some embodiments of the present invention, the proposed control scheme can relatively easily achieve the output current control together with power factor correction at the input side (i.e. the primary side).

For easy understanding, an example of a method of providing variable power to one or more LED arrays will now be given in combination with the driver 100 described above. First, a current is supplied to one or more LED arrays, such as LED array 120, by a power supply which may comprise the driver 100. Then, when a dimming demand signal is inputted at an input side of the power supply, the control unit 170 of the driver 100 will control the switching power unit 160 to adjust the current to the LED array 120 so as to satisfy the dimming demand. As described above, the control is implemented on the basis of a comparison between a dim reference signal sampled by the first sampling sub-unit 171 and a feedback signal sampled by the second sampling sub-unit 172. The dim reference signal represents phase-modulating information at the input side of the power supply. The feedback signal represents an average value of the current to the LED array 120. For more details, reference is made to the description of drivers 100 and 200.

As the dimming input is at the primary side (i.e. the input side), a common dimmer can be used in embodiments of the present invention so as to control the light output of the LED array, which makes it possible to utilize the LED array in currently existing lighting infrastructures.

The embodiments described above are merely preferred embodiments of the present invention. Other variations of the disclosed embodiments can be understood and effected by those skilled in the art in practicing the claimed invention, from a study of the drawings, the disclosure, and the appended claims. These variations shall also be considered to be within the scope of the present invention. In the claims and description, use of the verb "comprise" and its conjugations does not exclude other elements or steps, and the indefinite article "a" or "an" does not exclude a plurality.

The invention claimed is:

1. A driver for providing variable power to at least one LED array when coupled through a phase-modulating dimmer to an AC power supply, the driver comprising:

a filtering and rectifying unit for attenuating electromagnetic interference from/to the AC power supply and converting an AC power from the AC power supply into a DC power output;

a switching power unit for receiving the DC power output from the filtering and rectifying unit and providing an output current to the LED array; and a control unit for determining the output current to the LED array in response to a comparison between a dim reference signal representing phase-modulating information of the AC power when the phase angle of the AC power is cut by the phase-modulating dimmer and a feedback signal representing an average value of the output current to the LED array, wherein the control unit comprises a first sampling sub-unit adapted to sample the dim reference signal and cause the dim reference signal to be in a low frequency range, and a second sampling sub-unit adapted to sample the feedback signal and cause the feedback signal to be in a low frequency range.

2. The driver according to claim 1, wherein the dim reference signal is approximately a flat voltage signal.

3. The driver according to claim 1, wherein the feedback signal is kept in a voltage waveform in accordance with a current waveform of the output current to the LED array,

4. The driver according to claim 1, wherein the cross-over frequency of the control unit is lower than 50 HZ.

5. The driver according to claim 4, wherein the cross-over frequency is lower than 15 HZ.

6. The driver according to claim 1, wherein the switching power unit is arranged in a single-stage configuration and comprises a flyback transformer.

7. The driver according to claim 1, wherein the control unit comprises a third sampling sub-unit adapted to sample a voltage signal reflecting a voltage waveform of the AC power, and wherein the control unit is adapted to implement a power factor correction in response to the voltage signal.

8. A lighting device comprising at least one LED array and a driver according to claim 1.

9. A method of providing variable power to at least one LED array, the method comprising the steps of:

supplying current to the LED array by means of a power supply; and adjusting the current in accordance with a dimming demand signal at an input side of the power supply, by performing a comparison between a dim reference signal representing phase-modulating information at the input side of the power supply and a feedback signal representing an average value of the current to the LED array, wherein the adjusting step comprises a first sub-step of sampling and low-pass filtering the dim reference signal, and a second sub-step of sampling and low-pass filtering the feedback signal.

10. The method according to claim 9, wherein the adjusting step is further based on a voltage signal reflecting the voltage waveform at the input side of the power supply for acquiring a power factor correction.

11. A driver for providing variable power to at least one LED array when coupled through a phase-modulating dimmer to an AC power supply, the driver comprising:

a filtering and rectifying unit for attenuating electromagnetic interference from/to the AC power supply and converting an AC power from the AC power supply into a DC power output;

a switching power unit for receiving the DC power output from the filtering and rectifying unit and providing an output current to the LED array; and a control unit for determining the output current to the LED array in response to a comparison between a dim reference signal representing phase-modulating information of the AC power when the phase angle of the AC power is cut by the phase-modulating dimmer and a feedback signal representing an average value of the output current to the LED array, wherein the control unit comprises a third sampling sub-unit adapted to sample a voltage signal reflecting a voltage waveform of the AC power, and wherein the control unit is adapted to implement a power factor correction in response to the voltage signal.

12. The driver according to claim 11, wherein the dim reference signal is approximately a flat voltage signal.

13. The driver according to claim 11, wherein the feedback signal is kept in a voltage waveform in accordance with a current waveform of the output current to the LED array,

14. The driver according to claim 11, wherein the cross-over frequency of the control unit is lower than 50 HZ.

* * * * *